United States Patent [19]

Scherf et al.

[11] Patent Number: 4,931,917

[45] Date of Patent: Jun. 5, 1990

[54] TRAPEZE LIGHTING FIXTURE

[75] Inventors: Timothy P. Scherf, Tustin; Daniel J. Dix, Irvine; Douglas W. Carson, Downey, all of Calif.

[73] Assignee: Thomas Industries Inc., Louisville

[21] Appl. No.: 222,038

[22] Filed: Jul. 21, 1988

[51] Int. Cl.[5] ..... F21V 21/28

[52] U.S. Cl. ..... 362/371; 362/275; 362/419; 362/427

[58] Field of Search ..... 362/269, 370, 371, 418, 362/346, 275, 285, 419, 427; 248/278, 291, 316.1

[56] References Cited

U.S. PATENT DOCUMENTS

| | | | |
|---|---|---|---|
| 1,830,355 | 11/1931 | Farr | 248/278 |
| 2,220,220 | 11/1940 | Cusimano | 248/278 |
| 2,967,230 | 1/1961 | Goetz et al. | 362/269 |
| 3,246,135 | 4/1966 | Husby | 362/269 |
| 3,303,336 | 2/1967 | Husby | 362/275 |
| 4,236,194 | 11/1980 | Norman | 362/370 |
| 4,380,792 | 4/1983 | Terrell | 362/275 X |
| 4,727,460 | 2/1988 | Payne | 362/287 X |

*Primary Examiner*—Stephen F. Husar

*Attorney, Agent, or Firm*—Hill, Van Santen, Steadman & Simpson

[57] ABSTRACT

An adjustable fixture for holding a lamp of the type having a rim which includes a frame rotatably carried on a support arm by an attachment device that permits selected rotation of the frame relative to the support without adjustment of the attachment device. Further, the frame includes engagement springs to securely hold the lamp at a distance from the frame. A stop device is provided to provide a limit to the rotational movement between the frame and the support.

17 Claims, 1 Drawing Sheet

TRAPEZE LIGHTING FIXTURE

BACKGROUND OF THE INVENTION

The present invention relates generally to lighting fixtures, as in particular to a track mounted lighting fixture for a sealed beam lamp.

Track mounted lighting fixtures for sealed beam lamps are known, such as disclosed in U.S. Pat. No. 4,727,460 in which the fixture includes a pair of U-shaped members having a space for receiving the rim of a sealed beam lamp therebetweeen in the bight region of the two U-shaped members. A pair of springs urge the lamp into the bight of the U-shaped members.The U-shaped members are firmly connected to a bridging member which is pivotally and slidably secured to a support arm by means of a threaded knob. The support arm is connected to a track adaptor. The bridging member has a flat surface at one end and the knob also has a flat surface. The flat surfaces engage either side of the support arm either directly or through the intermediary of a washer to provide a bearing surface for rotation of the bridging member. The manually operable knob is provided to tighten or loosen the clamping arrangement between the bridging member, support arm and knob to prevent or permit rotation and vertical sliding of the bridging member relative to the support arm.

Difficulties can arise in assuring proper positioning of the sealed beam lamp in that such lamps are made by third party sources and variances in the thickness of the rim of the lamp is beyond the control of the fixture manufacture. Thus, if an overly thick rim is encountered, there may be difficulty in having the rim fit in the space between the two U-shaped portions.

Further, actuation of the knob to achieve a repositioning of the angle of the lamp is oftentimes inconvenient because of the mounted position of the fixture on a back lighting system.

SUMMARY OF THE INVENTION

The present invention provides a lighting fixture for track mounted lighting systems in which a sealed beam bulb is suspended at at least three points by spring clips mounted in a holder or frame member. The holder member preferably has a curved mid portion such that it comprises a U-shape, however a rectangular frame would work just as well. The ends of the holder member are carried in a connector bar which is rotatably held, in cantilever fashion, on a support arm which in turn is rotatably suspended from an adaptor designed to engage with an electricity conducting track.

The connecting bar is preferably an extruded material having radially inwardly directed ribs which terminate short of the center of the connecting bar. An end face of the support arm has three projecting fingers which laterally engage with the radially inwardly directed ribs to act as stops for rotation of the connecting bar relative to the support arm. In a preferred embodiment, the connecting bar is rotatable through 90° relative to the support arm. thus, the holder can be rotated between a horizontal position and a vertical position.

A plurality of spring washers are provided which are permanently clamped within a space between the ends of the ribs of the connecting bar and the support arm to permit rotation of the connecting arm relative to the support bar upon a application of a sufficient force, but which otherwise maintain the connecting bar in a fixed position relative to the support arm. Thus, actuation of knobs or other adjustments between the support arm and connecting bar are not required in order to effect rotation of the lamp.

DESCRIPTION OF THE PREFERRED EMBODIMENTS

Figures 1, 2, 3, 4, 5, 6:
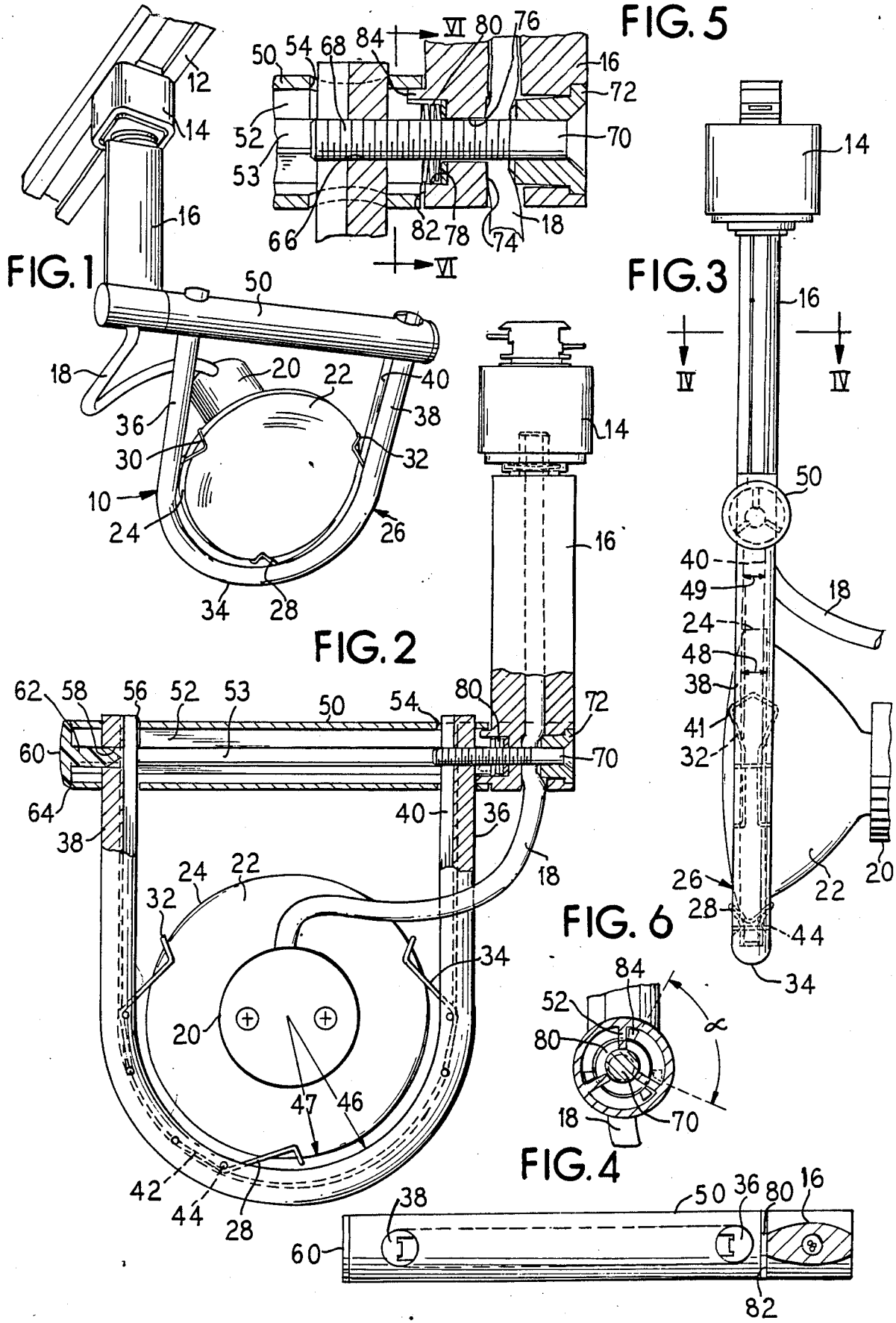
FIG. 1 is a perspective view of a lighting fixture embodying the principles of the present invention.
FIG. 2 is a rear elevational view of the fixture of FIG. 1, partially shown in section.
FIG. 3 is a side elevational view of the lighting fixture of FIG. 1.
FIG. 4 is a sectional view of the lighting fixture taken generally along the line IV—IV of FIG. 2.
FIG. 5 is an enlarged sectional view of the connection area between the support arm and connecting bar of the lamp fixture of FIG. 2.
FIG. 6 is a sectional view taken generally along the line VI—VI of FIG. 5.

In FIG. 1 there is illustrated a lighting fixture generally at 10 which is to be mounted to a track member 12 carrying electrical current. An adaptor 14, well known to those in the art, is provided as a slidable connector for attaching the lighting fixture to the track 12. Depending from the adaptor 14 is a support arm 16 which is rotatably connected to the adaptor 14 so that it may rotate about a vertical axis as selected by the user. An electrical cord 18 extends through the support arm 16 to a bulb receptacle 20. A bulb 22 such as a sealed beam lamp is threadingly received in the receptacle 20 in a manner well known in the art.

Sealed beam bulbs generally have an annular rim 24 and to secure the lamp 22 in the lighting fixture 10, a frame 26 is provided which includes at least three spring clips 28, 30, 32 to engage the rim 24 of the lamp at approximately 3 equally spaced locations. The frame 26 is shown in the shape of a U with a first of the spring clips 28 being positioned at a bight 34 of the U and the remaining two spring clips 30, 32 being attached to relatively straight legs 36, 38 of the frame. While the U shape is aesthetically pleasing in that the bight portion 34 generally follows the curvature of the lamp 24, it is not necessary for the frame 26 to be curved as shown. The frame 26 can also be formed in a rectangular shape or other shapes, however, in terms of aesthetics, ease of manufacturing and cost, the curved U-shape is preferable.

As shown in FIG 2, the frame is shown as having a groove 40 along an interior portion thereof, the groove being provided as a seating area for the spring clips 28, 30, 32 which each are formed in a generally U-shape with an enlarged bight portion 41 lying above the groove 40 and leg portions 42 which lie within the groove 40 and are held in place by pins 44. Since the frame 26 has an internal radius of curvature 46 which is larger than a radius of curvature 47 of the lamp, the rim 24 of the lamp is not and cannot be held in the groove 40. Further, as shown in FIG. 3, a thickness 48 of the rim 24 is greater than a width 49 of the groove 40 and thus it is not possible for the rim of the lamp to be seated in the groove. The enlarged bight portion 41 is sufficiently wide to receive the rim 24 of the lamp. Thus, wide ranges of thicknesses of the lamp rim can be accomodated.

The legs 36, 38 of the frame are secured to a connecting bar 50 which in turn is rotatably connected to the support arm 16 in a cantilevered fashion.

Preferably the connecting bar 50 is an extruded member having a plurality, preferably 3, of inwardly extending ribs 52 (FIG. 6) extending the entire length of the bar 50. The ribs 52 terminate short of the center of the bar so as to provide a central open space 53. A pair of diametrical through bores 54, 56 are provided through the connecting bar 50 for receiving the legs 36, 38 of the frame 26. The leg 38 which is positioned furthest from the support arm 16 has a diametrical through bore 58 (FIG. 2) which aligns with the open space 53 between the ribs 52 when the leg 38 is inserted a correct distance into the bore 56 of the connecting bar 50. A plug member 60 having a diameter approximately the same as the connecting bar 50 and having a ribbed shank 62 is inserted into an open end 64 of the connecting bar, the shank 62 extending into the bore 58 of the leg 38 to secure the leg 38 relative to the connecting bar 50.

The leg 36 of the frame 26 which is closest to the support arm 16 has a threaded diameterical through bore 66 which receives a threaded shank 68 of a bolt 70 which first extends through the support arm 16 and then into the threaded bore 66 of the arm 36.

The bolt 70 has a head 72 which compresses the electrical cord 18 against a solid internal portion of the support arm at 74 to provide a strain relief for the cord. The bolt 70 extends through an opening 76 in the solid portion 74 and into the open space 53 between the ribs in the connecting bar 50 and then into the threaded bore 66 in the leg 36.

As best seen in FIG. 5, a pocket 78 is formed in the support arm 16 in which is received a plurality of spring or wave washers 80 which have a stack height greater than that of the pocket 78 such that the washers, even when compressed, extend beyond an end face 82 of the support arm 16. Thus, the support arm 16 does not engage the connecting bar 50, rather the connection is made through the stack of washers 80 with the ribs 52 of the connecting bar. Preferably an adhesive such as LOKTITE is applied to the threaded shank 68 of the bolt so that the connecting bar 50 and support arm 16 will be permanently connected and so that compression of the spring washers 80 will remain constant.

A plurality of projections 84 (FIGS. 5 and 6), preferably 3, are provided which extend beyond the end face 82 of the support arm 16 and which extend into the spaces between the ribs 52 of the connecting bar 50. The projections laterally engage with the ribs 52 and provide a stop against excessive rotation of the connecting bar relative to the support arm. As seen in FIG. 6, with three ribs 52 and three projections 84, a rotational $\alpha$ of approximately 90° results which permits the orientation of the lamp to be rotated from horizontal to vertical.

The frictional force of the spring washers 80 allows rotation of the connecting bar 50 only upon the application of sufficient force by a user so that when such force is terminated, the lamp will stay in the desired position. Therefore, no parts such as knobs or screws need to be loosened and retightened in order to effectuate rotation of the lamp. Since the connecting bar 50 is rotatable through at least 90° on the support arm 16 and since the support arm 16 is rotatable about a vertical axis relative to the adaptor 14, the light generated by a lamp 24 can be directed in any desired direction.

Thus, it is seen that the present invention provides an adjustable fixture for holding a lamp of the type having a rim which comprises a frame means in the form of the frame 26 and connecting bar 50 which at least partially surrounds the lamp and has engagement means in the form of the spring clips 28, 32, 34 for securely holding the lamp at a position entirely spaced from the frame means. Further, a support means in the form of the support arm 16 is provided which is rotationally attached to the frame means such that the frame means is rotatable relative to the support means about a rotational axis, yet is permanently held in a fixed position relative to the support means along the axis by the threaded bolt which is securely and permanently bonded in place. Further, stop means in the form of the projections 84 and ribs 52 limit the range of rotation permitted between the frame means and the support means. Thus, lamps having a wide range of thickness of their rims are accomodated by this adjustable fixture and repositioning of the frame means relative to the support means is quickly and easily accomplished without the need for adjustment of any fastening or securing devices.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

I claim as my invention:

1. An adjustable fixture for holding a lamp of the type having a rim, comprising:

frame means at least partially surrounding said lamp and having engagement means projecting inwardly therefrom for securely holding said lamp at a position entirely spaced from said frame means; and support means having at one end connection means for attachment to a source of electric current, and at an opposite end rotationally attached to said frame means such that said frame means is rotatable relative to said support means about a rotational axis, yet permanently held in a fixed axial position relative to said support means.

2. An adjustable fixture according to claim 1, wherein said frame means comprises a U-shaped member with a bight and two legs, the legs being connected by a connecting bar.

3. An adjustable fixture according to claim 2, wherein said engagement means are mounted on and project from said U-shaped member.

4. An adjustable fixture according to claim 2, wherein said frame means is attached to said support means at said connecting bar.

5. An adjustable fixture according to claim 1, wherein said engagement means comprises a plurality of spring members.

6. An adjustable fixture according to claim 1, wherein said support means is attached to said frame means by a threaded fastener which is permanantly bonded in place.

7. An adjustable fixture according to claim 6, including a plurality of spring washers carried on said threaded fastener and being positioned between said support means and said frame means.

8. An adjustable fixture for holding a lamp of the type having a rim, comprising:

a frame with two free ends partially surrounding the rim of the lamp and having at least three spaced spring clips adapted to engage and hold the lamp proximate the rim thereof in a spaced relationship relative to said frame;

an elongated connecting bar extending between said two free ends of said frame;

a support arm having at one end connection means for attachment to a source of electric current and at an opposite end including attachment means for selected rotational attachment to said connecting bar, said attachment means comprising means for permanently securing said connecting bar to said support arm in an axial direction while permitting relative rotational movement therebetween about said axis.

9. An adjustable fixture according to claim 8, wherein said frame comprises a U-shaped member with a curved bight having a diameter larger than a diameter of said lamp.

10. An adjustable fixture according to claim 8, including means for limiting rotational movement between said support arm and said frame.

11. An adjustable fixture according to claim 10, wherein said means for limiting rotational movement comprises projecting means on one of said support arm and frame and stop means on the other of said support arm and frame arranged such that sufficient rotation of said frame relative to said support arm will cause an abutment of said projecting means with said stop means.

12. An adjustable fixture for holding a lamp of the type having a rim, comprising:

frame means at least partially surrounding said lamp;

engagement means projecting inwardly from said frame means for securely holding said lamp at a position entirely spaced from said frame means;

support means having at one end connection means for attachment to a source of electric current, and at an opposite end rotationally attached to said frame means;

attachment means for securing said frame means to said support means such that said frame means is rotatable relative to said frame means is rotatable relative to said support means about a rotational axis, yet permanently held in a fixed axial position relative to said support means; and stop means engageable between said frame means and said support means to limit the range of rotation permitted between said frame means and said support means.

13. An adjustable fixture according to claim 12, wherein said stop means comprises projecting means on one of said support means and frame means and abutment means on the other of said support means and frame means such that a predetermined rotation of said frame means relative to said support means will cause arresting engagement between said projecting means and said abutment means.

14. An adjustable fixture according to claim 12, wherein said frame means comprises a U-shaped member with a bight and two legs, the legs being connected by a connecting bar.

15. An adjustable fixture according to claim 12, wherein said engagement means comprises a plurality of spring members.

16. An adjustable fixture according to claim 12, wherein said attachment means comprises a threaded fastener which is permanently bonded in place.

17. An adjustable fixture according to claim 16, including a plurality of spring washers carried on said threaded fastener and being positioned between said support means and said frame means.

* * * * *